US007192679B2

(12) United States Patent
Yamaguchi et al.

(10) Patent No.: US 7,192,679 B2
(45) Date of Patent: Mar. 20, 2007

(54) CARRIER FOR ELECTROPHOTOGRAPHIC DEVELOPER

(75) Inventors: Kimitoshi Yamaguchi, Numazu (JP); Naoki Imahashi, Mishima (JP); Akihiro Kotsugai, Numazu (JP); Hiroaki Takahashi, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 10/802,754

(22) Filed: Mar. 18, 2004

(65) Prior Publication Data

US 2005/0064315 A1 Mar. 24, 2005

(30) Foreign Application Priority Data

Mar. 19, 2003 (JP) ..... 2003-075631
Feb. 2, 2004 (JP) ..... 2004-025283

(51) Int. Cl.
*G03G 9/00* (2006.01)

(52) U.S. Cl. ..... 430/111.33; 430/111.35; 430/111.4; 430/111.41

(58) Field of Classification Search ..... 430/111.33, 430/111.35, 111.4, 111.41
See application file for complete search history.

(56) References Cited

U.S. PATENT DOCUMENTS

| | | | |
|---|---|---|---|
| 3,029,180 | A | 4/1962 | Laliberte |
| 4,562,136 | A | 12/1985 | Inoue et al. |
| 4,590,141 | A | 5/1986 | Aoki et al. |
| 4,670,368 | A | 6/1987 | Tosaka et al. |
| 4,950,573 | A | 8/1990 | Yamaguchi et al. |
| 4,990,425 | A | 2/1991 | Nanya et al. |
| 5,079,123 | A | 1/1992 | Nanya et al. |
| 5,085,965 | A | 2/1992 | Nanya et al. |
| 5,102,766 | A | 4/1992 | Nanya et al. |
| 5,288,577 | A | 2/1994 | Yamaguchi et al. |
| 5,368,972 | A | 11/1994 | Yamashita et al. |
| 5,418,103 | A | 5/1995 | Muto et al. |
| 5,429,901 | A | 7/1995 | Muto et al. |
| 5,912,100 | A | 6/1999 | Aoki et al. |
| 6,004,715 | A | 12/1999 | Suzuki et al. |
| 6,010,814 | A | 1/2000 | Kotsugai et al. |
| 6,168,894 | B1 | 1/2001 | Aoki et al. |
| 6,406,826 | B1 | 6/2002 | Suzuki et al. |
| 6,472,118 | B1 | 10/2002 | Yamaguchi et al. |
| 6,489,073 | B2 | 12/2002 | Kotsugai et al. |
| 6,599,672 | B2 | 7/2003 | Yamaguchi et al. |
| 6,653,037 | B2 | 11/2003 | Sawada et al. |
| 6,696,213 | B2 | 2/2004 | Yamaguchi et al. |
| 6,716,561 | B2 | 4/2004 | Shiraishi et al. |
| 6,739,534 | B2 | 5/2004 | Yamaguchi et al. |
| 6,743,558 | B2 * | 6/2004 | Yamaguchi et al. .... 430/111.33 |

FOREIGN PATENT DOCUMENTS

| | | |
|---|---|---|
| JP | 58-144839 | 8/1983 |
| JP | 07-098521 | 4/1995 |

OTHER PUBLICATIONS

U.S. Appl. No. 11/373,109, filed Mar. 13, 2006, Imahashi, et al.
U.S. Appl. No. 11/508,922, filed Aug. 24, 2006, Imahashi, et al.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

The present invention relates to a carrier for electrophotographic developers, a developer containing the carrier, a container for the developer, a image forming apparatus using the developer, an image forming method using the same, and a method of making the carrier.

22 Claims, 6 Drawing Sheets

CARRIER FOR ELECTROPHOTOGRAPHIC DEVELOPER

FIELD OF INVENTION

The present invention relates to a carrier for electrophotographic developers, a developer containing the carrier, a container for the developer, a image forming apparatus using the developer, an image forming method using the same, and a method of making the carrier.

Additional advantages and other features of the present invention will be set forth in part in the description that follows and in part will become apparent to those having ordinary skill in the art upon examination of the following or may be learned from the practice of the present invention. The advantages of the present invention may be realized and obtained as particularly pointed out in the appended claims. As will be realized, the present invention is capable of other and different embodiments, and its several details are capable of modifications in various obvious respects, all without departing from the present invention. The description is to be regarded as illustrative in nature, and not as restrictive.

DESCRIPTION OF THE BACKGROUND

In electrophotography, an electrostatic latent image formed on a photosensitive member is developed by a developer. One-component developers composed of a toner, and two-component developers composed of a toner and a carrier, such as glass beads and magnetic particles with or without resin coating, are known. Two-component developing is advantageous in comparison with one-component developing, because it uses a carrier which has large surface area, causing satisfactory triboelectric-charge for the toner, thereby making the charge of the toner stable and capable of holding high quality images for a long period of developing time.

Two-component developers are also preferred in certain high-speed apparatuses.

Two-component developing is also being widely used in digital electrophotographic systems where latent electrostatic images are formed onto a photosensitive member by laser beam-irradiation and the like, followed by developing the latent images.

Recently, size reduction and condensed distribution of dot units for latent image (pixel units) have been designed to satisfy the requirements for improving the resolution degree, reproducibility of highlight image and faithful color-imaging.

In particular, an important concern in the field is the achievement of a developing system which enables a faithful development of those latent image (dots comprising each image). Therefore, many proposals were made, both from the point of processing means and from the developer (toner and carrier). As for the processing means, a restriction of development gap and thinning of the layers comprising photosensitive member are effective; however, there are still problems in that cost is increased as a result of such improvements, and sufficient reliability is not yet achieved, and the like.

On the other hand, with regard to the developer side, dot reproducibility is considerably improved by using small sized toner. However, problems occur with developers using small sized toners, such as staining (smearing) in the background area, low image density, and others. And, in case of a toner having a small size used for full-color images, resins having a low softening-temperature are generally used which, in comparison with black toner, increase the spent amount on the surface of carrier, degrade the quality of developer over time, and show a tendency towards toner-scattering and background stain.

Various proposals for using small sized carrier have also been proposed. For example, Japanese Laid-open patent Publication No.58-144839 discloses a magnetic carrier for an electrophotographic developer using carrier particles which comprising ferrite particles of spinel structure, wherein the carrier particles having a average particle diameter of less than from 30 μm. The carrier, which is not covered with a resin layer, is used with a low developing electric field. Because the toner is not covered with a resin layer, the lifetime of it is short, and its developing ability is not sufficient.

Japanese granted patent No. 3029180 discloses a carrier for an electrophotographic developer using carrier particles, wherein the carrier particles have a size ranging from 15 μm to 45 μm in 50%-average diameter (D50), the content of smaller carrier particles less than 22 μm in size ranging from 1 to 20%, the content of small carrier particles less than 16 μm in size is not higher than 3%, the content of large carrier particles more than or equal to 62 μm in size ranges from 2% to 15%, the content of larger carrier particles more than 88 μm in size not higher than 2%, and the carrier satisfies a ratio (S1/S2) of surface area (S1) measured by air-permeation in comparison with surface area ($S_2$), a range represented by;

$$1.2 \leqq (S1/S2) \leqq 2.0$$

wherein the S2 represents surface area ($S_2$) calculated from the following;

$$S2=(6/\rho \cdot D50)\times 10^4$$

wherein, the ρ is specific gravity of the carrier.

The use of this kind of carrier is stated to provide the following benefits;

(1) Surface area per unit volume is large, therefore they can give a good enough triboelectric-charge for each toner, and scarcely yield toners which have a low level of electric-charge and reverse polarity-charge too, accordingly scattering of toner particles at the periphery of dot for image-forming and smear (blurring) in background area are few, thus dot reproducibility is excellent;

(2) Due to the nature of large surface area per unit volume and low generation of smear in the background area, low level of average electric-charge in the toner is allowable, notwithstanding, high image density is obtained, thus a carrier of small diameter is able to compensate the shortcomings caused by use of small size of toner, and hence is effective for driving out the advantages of small size of toner;

(3) As a small diameter carrier forms a dense magnetic brush, and the head of the formed magnetic brush has excellent fluidity, the trace drawn by dragging of the head of the magnetic brush on the image is hardly imprinted.

However, carriers of small diameter in the prior art have an important problem in that that they are apt to deposit themselves on surfaces contacted with the developer, thus providing flaws on the photosensitive member or fixing roller. Thus, they are difficult to utilize, and impractical.

SUMMARY OF THE INVENTION

One object of the present invention is to provide a carrier for electrophotographic developers and developers using the same which are able to produce high quality image-reproductions having excellent dot-reproducibility, and excellent reproducibility, high image density, and showing little or no background smear.

Another object of the present invention to provide a container for the invention developer, containing the developer.

A further object of the present invention is to provide an image-forming apparatus that includes the container for developer.

Yet another object of the present invention is to provide a preparation method of the carrier.

In accordance with the present invention, there is provided a carrier for an image developer for electrophotography, which comprises core particles, with a resin layer covering the core particles.

DETAILED DESCRIPTION OF THE PREFERRED EMBODIMENTS

Figure 1:
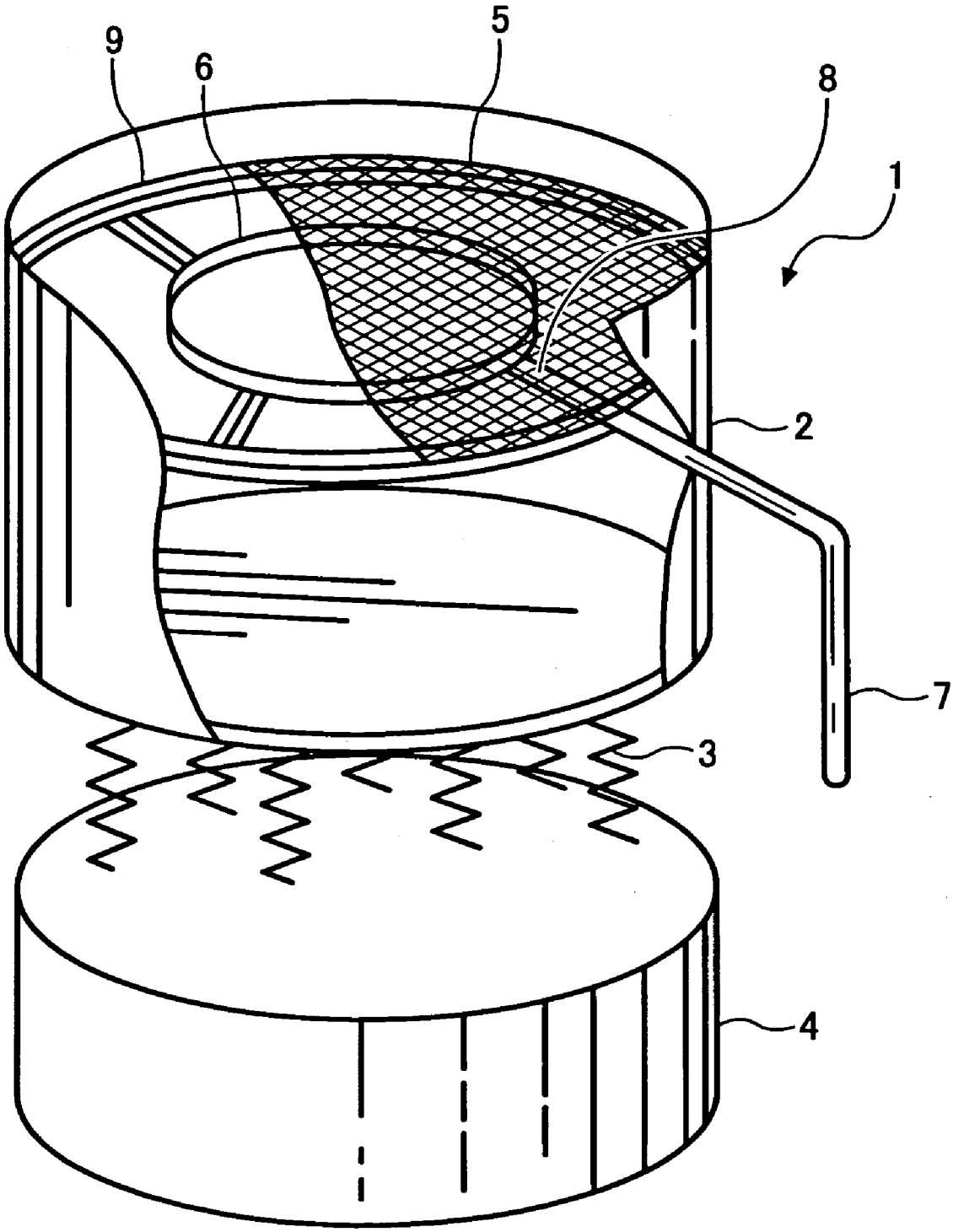
FIG. 1 is a perspective view of an embodiment of a vibration screen classifier equipped with an ultrasonic wave vibrator and favorably used in the present invention.

The invention carrier useful in/for/as an electrophotographic developer ("carrier") of the present invention comprises particles of a core material and, thereon, a resin layer. Preferably, the invention carrier has the following characteristics:

(1) the weight-average particle-diameter (Dw) is 22–32 μm, preferably 23–30 μm, [A (Dw) above this range makes it hard to deposit the carrier, increases smearing (staining) of the background, and causes a large variance of dot diameter in the case of development of small dots for a latent image.]

(2) The content of particles having a diameter less than 20 μm is less than or equal to 5 wt %, such as 4 wt %, preferably less than or equal to 3 wt %, including 2, 1, 0.5 wt % etc. When particles having a particle diameter of less than 20 μm are present in an amount of more than 7 wt %, the particle distribution is broad, and low magnetization particles (small particles). The ratio of particles which have a diameter less than 36 μm is 90 wt % or more, more preferably 92 wt % or more.

Preferably 98 wt % or more of the particles have a diameter less than 44 μm. With the invention carrier the scatter of the magnetization of each carrier particle becomes small, and the sharp size distribution improves the deposition of carrier drastically.

Weight average particle diameter (Dw) of the carrier is calculated by measuring the particle size-distributions (showing the relationship between frequencies and numbers of particles by particle diameter-division).

The weight average particle diameter (Dw) is represented by equation as follows:

$$Dw=\{1/\Sigma(nD^3)\}\times\{\Sigma(nD^4)\}$$

wherein,

D: representative particle diameter in each channel (μm)

n: number of particles in each channel.

The channel mentioned above is a unit for dividing the abscissa axis indicating particle size in the graph showing the whole particle size-distribution, and each channel has a 2 μm width in case of the present invention. The representative particle size by each channel was designated as the smallest size in the each channel in the present invention.

As used herein, number average particle diameter (Dp) of the carrier, which is related to both a magnetic carrier core and toner in the present invention, is calculated by measuring the particle size-distributions $$Dp=(1/N)\times\{\Sigma(nD)\}$$

wherein,

N: total number of particles measured n: number of particles in each channel

D: representative particle diameter in each channel (μm)

The representative particle size in each channel (2 μm) was designated as the smallest size in the each channel in case of the present invention.

The above-mentioned particle diameters in the present invention were measured using a Micro-Track particle size analyzer (Model HRA-9320-X 100 manufactured by Honeywell Co. Ltd.), with following measuring conditions.

(1) Scope of particles size: 8 to 100 μm (2) Channel width: 2 μm (3) Number of channels: 46

(4) Particle Refractive Index is 2.42

The term "carrier deposition" in the present invention means a phenomenon of depositing carrier onto electrostatic latent electrostatic image area or background area.

The carrier of the present invention can prepared by pulverizing a magnetic material, classifying the finely pulverized particles so as to obtain a core material of particles having the defined particle-diameter and preferably the defined distribution in particle diameter of the particles, then providing a film onto the classified magnetic core material. Others ways of making the invention carrier are possible, such as by coating before classifying, etc.

The above-mentioned classification includes air classification, sieve classification and the like. Vibration sieves can be used, however conventional vibration sieves may exhibit mesh straggle (clogging) for small particles.

In case of classifying the parts of small core particles, the yield decreases drastically, and becomes about 30%. That is why the particles larger than the targets are eliminated from product.

We have developed a method capable of removing small particles with high efficiency, and found that small particles less than 20 μm diameter are removed efficiently and sharply by adding a vibration using ultrasonic wave to vibrate the screen mesh in sieve classification process.

This ultrasonic wave-vibration for vibrating the screen mesh can be obtained by giving an electric power of high frequency to a converter (transducer) which uses a PZT vibrator and converts electric power to ultrasonic wave generating vibration power. For making vibration in screen mesh, vibration of ultrasonic wave is transferred to a resonator member.

The ultrasonic wave-vibration of the screen mesh direction is preferably perpendicular, which is fixed to the screen mesh, and the resonator member is resonated with the vibration of the ultrasonic wave to make vibration for the screen mesh. The frequency of the ultrasonic wave for vibration the screen mesh preferably ranges from 20 KHz to 50 KHz, more preferably from 30 KHz to 40 KHz.

As noted above, the carrier of the present invention can be provided as a core material by classification of particles of pulverized magnetic material. Alternately, classification can take place before, e.g., sintering in the case of ferrite and magnetite. It is possible to classify after sintering, and core materials can be provided. Classification of particles covered with resin is also possible. At each stage of core particles productions, it is preferably to use the above ultrasonic wave-vibration for vibrating the screen mesh.

Samples were made altering the magnetization (M) which influenced the magnetic restraint power (Fm) of the carrier. When a magnetic field at 1 KOe is applied to the carrier particle, the magnetization of the carrier particle preferably is more than 50 emu/g, more preferably more than 70 emu/g. Such values improve carrier depositon. The upper range of the magnetization of the carrier particle is not limited. Generally, the magnetization of carrier particle is preferably about 150 emu/g. When the magnetization of the carrier is less than the above ranges, carrier deposition is apt to occur. The magnetization of the carrier core particles may be measured with a B-H Tracer (model BHU-60 manufactured by Riken Denshi Kabushiki Kaisha). A sample (1.0 g) is filled in a cylindrical cell and subjected to varying magnetic fields. Thus, the magnetic field is gradually increased to 3,000 Oersteds (3 KOe) and then gradually decreased to zero (initial stage). Thereafter, a magnetic field is applied in the opposite direction. Thus, the magnetic field is gradually increased to 3 KOe and then gradually decreased to zero (second stage). Subsequently, a magnetic field is gradually increased to 3 KOe in the same direction as in the initial stage (third stage). The B-H curve is prepared through the first to third stages. The magnetic moment at an applied magnetic field at 1 KOe in the third stage is determined from the B-H curve.

Examples of carrier core materials providing a magnetic moment of at least 50 emu/g when applied with a magnetic field of 1 KOe include ferromagnetic materials such as iron and cobalt, magnetite, hematite, Li type of ferrite, Mn—Zn type of ferrite, Cu—Zn type of vferrite, Ni—Zn type of ferrite, Ba type of ferrite and Mn type of ferrite. Ferrite is a sintered material generally represented by the formula:

$$(MO)_x(NO)_y(Fe_2O_3)_z$$

wherein x+y+z=100 mol %, and M and N are metals such as Ni, Cu, Zn, Li, Mg, Mn, Sr, Ca and other relevant elements, considered to be perfect mixture of divalent metal oxide and ferric oxide.

More preferable examples of carrier core materials providing magnetization of at least 70 emu/g when applied with a magnetic field of 1 KOe include Fe, magnetite, Mn—Mg—Sr type of ferrite, and Mn type of ferrite.

Bulk density of the carrier is preferably greater than or equal to 2.1 g/cm$^3$, more preferably greater than or equal to 2.35 g/cm$^3$ (advantageous for preventing carrier deposition). Carrier of small bulk density is in general porous or has a surface that is concave-convex. A smaller bulk density of the carrier is more disadvantageous for preventing carrier deposition because even if the carrier has large amount of magnetization (emu/g) at 1 KOe of carrier field, substantial value of magnetization per particle is reduced. And concave-convex cause a different thickness of resin coating by location, therefore unevenness of electric charge and electric resistance by location is likely to occur, effecting durability and carrier deposition for long period of running time.

It is possible by increasing a sintering temperature to enlarge the bulk density of thje material. However, when a sintering temperature is increased, core materials melt and agglomerate easily, and don't pulverize easily. Therefore, Bulk density under 2.60 cm$^3$ is preferable, and a preferable range is 2.10 g/cm$^3$ to 2.60 g/cm$^3$, more preferably 2.35 g/cm$^3$ to 2.50 g/cm$^3$.

The specific resistance (Log R.cm) of the carrier of the present invention is preferably from 11.0 to 16.0, more preferably from 12.0 to 14.0. A specific resistance less than this range is unfavorable, because in the case where the developing gap (the most close distance between photosensitive member and development sleeve) becomes narrower, di-polarized electric charge is apt to be induced in the carrier, causing carrier deposition. A specific resistance more than above described degree is also unfavorable, because an opposite-polarized electric charge is apt to be induced in the carrier, again causing carrier deposition. The carrier of the present invention having above described degree of specific resistance, under the circumstance used in accompaniment with a toner having a relevant amount of electric charge, yields an acceptable image density.

DETAILED DESCRIPTION OF THE DRAWINGS

As shown FIG. 1, the vibration screen classifier equipped with an ultrasonic wave generator (transducer) (8) is connected with a supporting base (4) by spring (3). The vibration screen classifier (1) comprises a cylindrical housing (2) having a ring-wise inner frame (9) engaging spokes to support a resonator ring (6) which is fixed to a metal mesh (5) and to the ultrasonic wave generator (8) which is being connected with a cable (7) to supply high frequency electric power.

This vibration screen classifier (1) equipped with an ultrasonic wave generator (8) is driven by supplying a high frequency electric power, through cable (7), to the ultrasonic wave generator (8). The supplied high frequency electric power is, in the ultrasonic wave generator (8), converted ultrasonic wave. The ultrasonic wave generated by generator (8) vibrates resonator ring (6) fixed to the ultrasonic wave generator (8) and to the ring-wise frame (9) on which the ultrasonic wave generator (8) is fixed, thereby the metal mesh (5) is vibrated in perpendicular to the surface of the screen mesh (5).

This type of vibration screen classifier equipped with an ultrasonic wave generator is now commercially available, for example, a commodity name as "ULTRASONIC" made by Koei Sangyo Co. Ltd. and the like are instanced.

The carrier according to the present invention can obtained by classifying pulverized particles of magnetic material, or for example in the case of a core material such as ferrite or magnetite, they may be preliminarily formed in a first particle before sintering then classified, and sintered, and again classified if desired. Alternatively, the carrier may be prepared by providing at first a resin layer onto the core material, then classified the resin layer-provided particles. In this case it is preferable that the classification in each step of the resin layer-provided particles is conducted using the above-described vibration screen classifier equipped with an ultrasonic wave generator.

Figure 2:
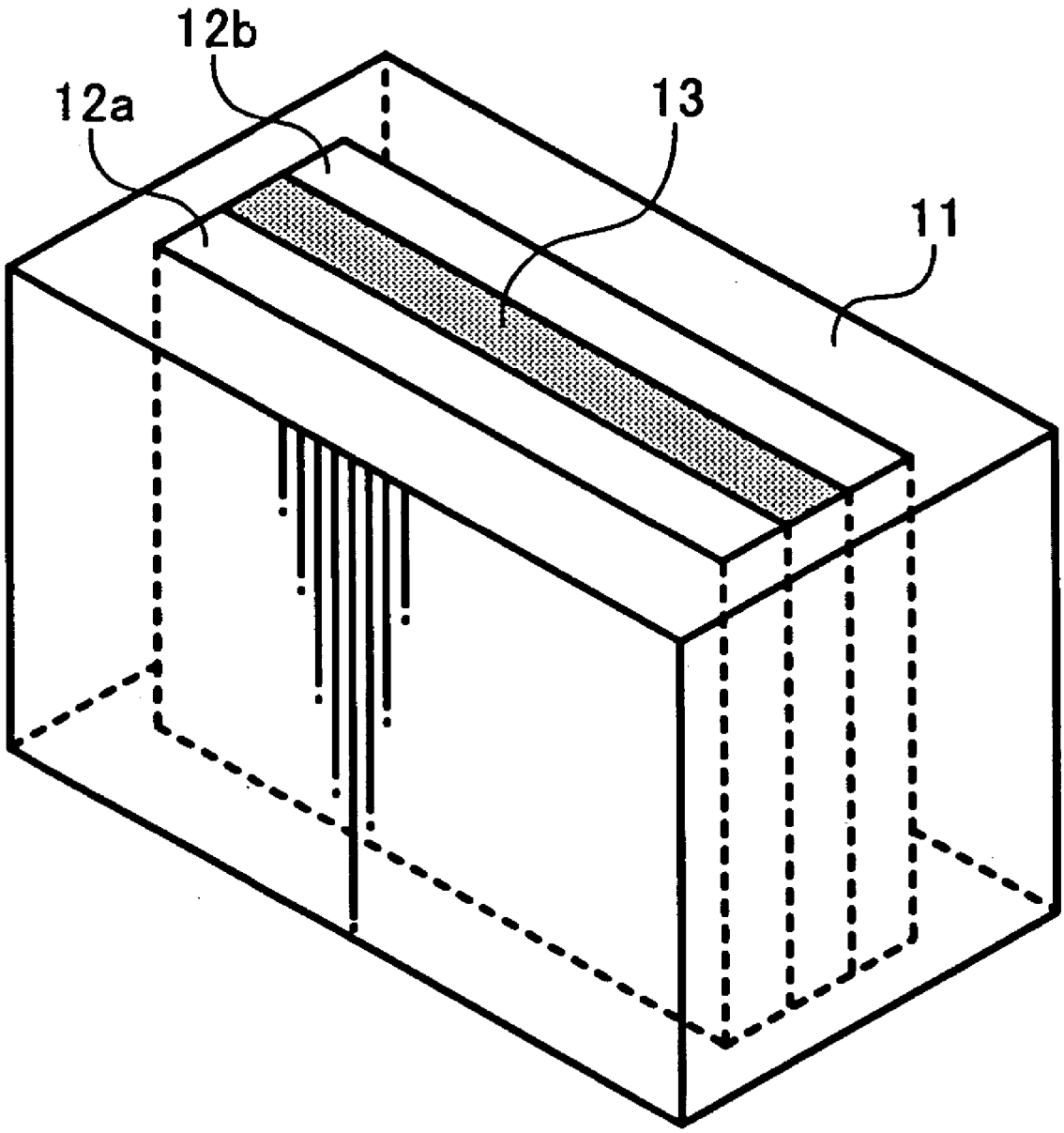
FIG. 2 is a perspective view of an electric resistance-measuring cell used for measuring the electric resistance of the carrier according to the present invention.

As shown in the FIG. 2, carrier (13) was filled in a cell which is made of fluoride resin and therein has electrodes (12*a*) (12*b*) of 2 mm distance and 2×4 cm of surface area, then DC electric voltage of 100V was applied between the electrodes to determine a DC electric resistance which is shown on High Resistance Meter 4329A (manufactured by Yokogawa Hewlett-Packard Co. Ltd.) and to calculate the specific resistance (Log R.cm) of the carrier.

Adjustment of the specific resistance (log R.cm) of the carrier can be effected by controlling the electric resistance and layer thickness of the resin to be coated upon carrier core material. And it is possible to adjust the specific resistance of the carrier by adding a conductive finely divided powder into the coating resin. As the conductive finely divided powder, metal or metal oxide powders such as ZnO powder and Al powder, $SnO_2$ prepared by various methods or doped by various elements, borides such as $TiB_2$, $ZnB_2$, $MoB_2$, silicon carbide, conductive polymers such as poly acetylene, poly paraphenylene, poly praphenylene-sulfide, poly pyrrole, electroconductive poly ethylene, carbon blacks such as furnace black, acethylene black, channel black, are instanced.

Those conductive finely divided powders may uniformly be dispersed by following manner, namely by adding the conductive finely divided powder into a solvent used for coating or a resinous solution for coating, and admixing the solvent or solution by using dispersing apparatus or stirrer equipped with paddles ratable with high revolution speed.

Figure 3:
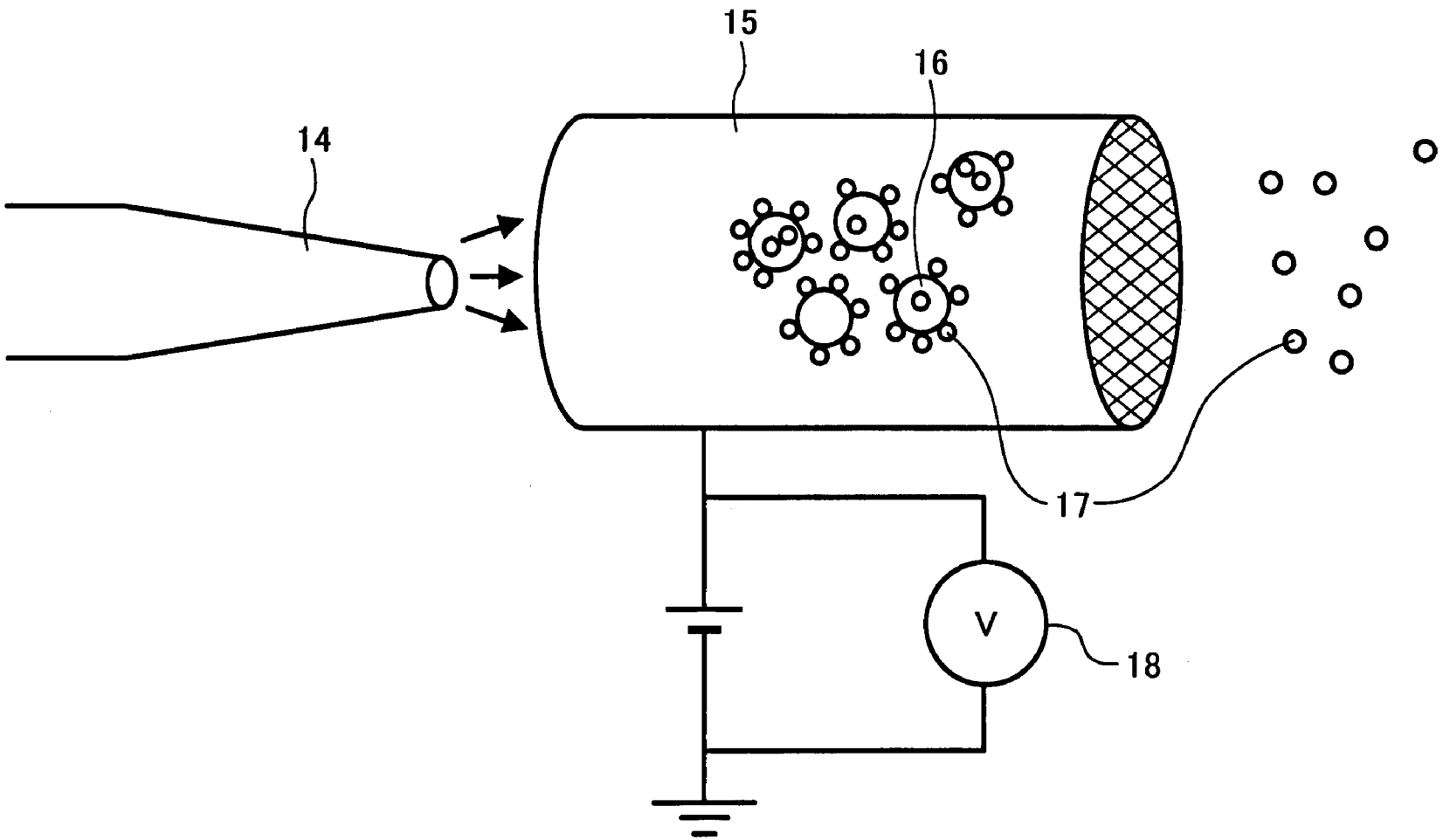
FIG. 3 is a measuring apparatus of toner charge to mass ratio in the present invention.

As shown in the FIG. 3, toner charge to mass ratio can be measured in the following method. The developer of fixed weight is put in conductive container (blow off cage) 15 provided with the metal mesh in both ends.

The aperture size of the mesh made of the stainless steel is chosen between the particle diameter of toner and that of carrier. (mesh size: 20 μm) Then, toner only pass through the opened space Toner is come out of the cage by spraying compressed nitrogen gas (1 kgf/cm$^2$) from the nozzle 14 for 60 sec.

Then, the carrier in the cage (15) has the charge which polarity is opposite to the toner. The charge (Q) and the mass (M) of the toner which comes out of the cage are measured, and toner charge to mass ratio is calculated as Q/M.

Figure 4:
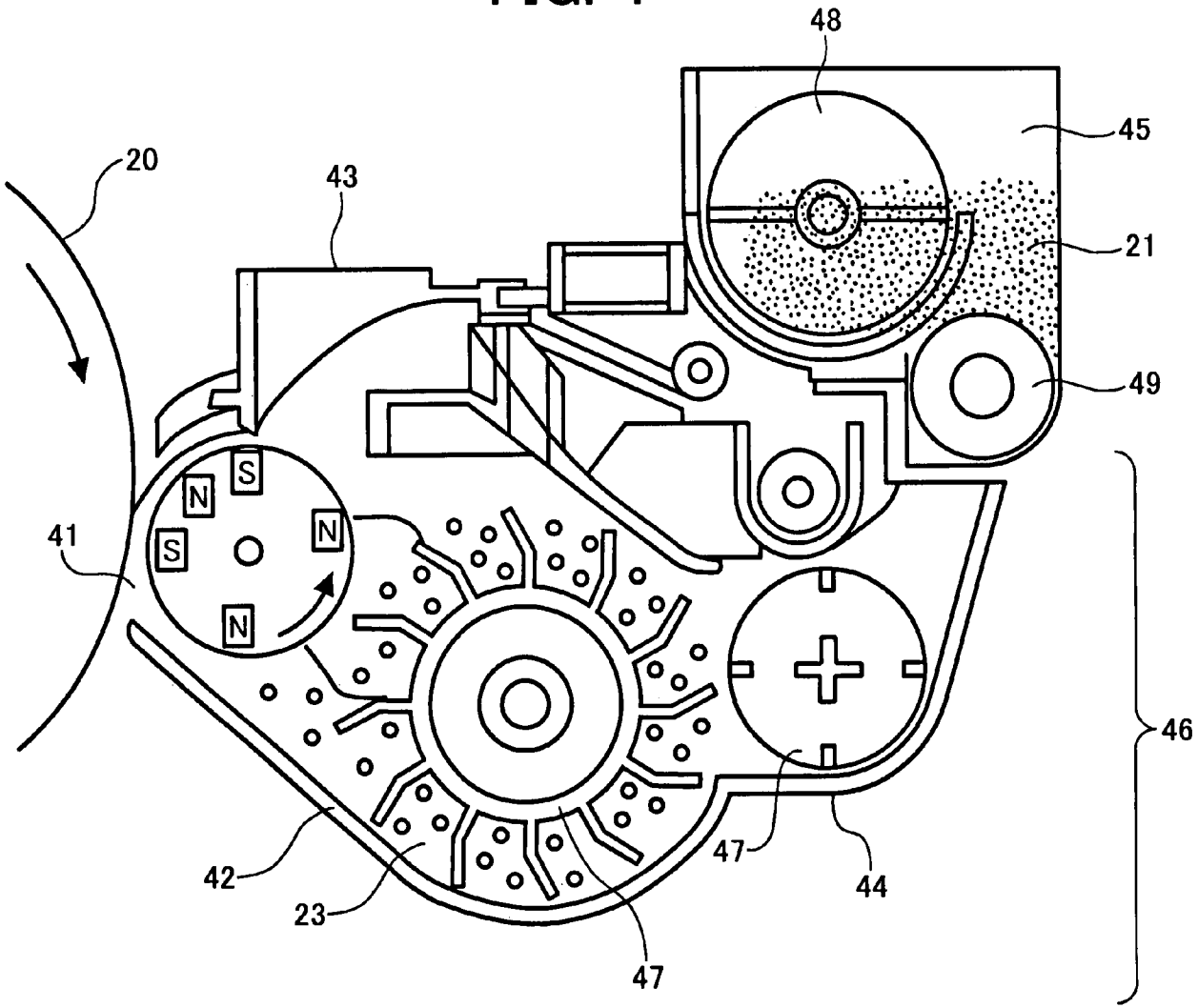
FIG. 4 is a schematic diagram of an embodiment of an electrophotographic image forming apparatus according to the present invention.

Shown in the FIG. 4 is an embodiment of the developing apparatus. The developing apparatus includes mainly a photoconductive drum (20) as latent electrostatic image holding member, a developing sleeve (41) as developer holding member, a developer housing (42), a doctor blade (43) as regulation member and container (44). A toner hopper (45) as a toner accommodation part which keeps toner (21) inside is connected with the support case (44) which has an opening on the photoconductive drum (20) side. A toner hopper (45) adjoins a developer accommodation department (46). A developer accommodation department (46) accommodates the developer which consists of toner (21) and carrier particles (23). Toner particles (21) and carrier particles (23) are stirred, and the developer stirring mechanism (47) to give a friction/release charge to the toner particles is being comprised by a developer accommodation department (46).

Inside a toner hopper (45), there are disposed a toner agitator (48) and a toner replenishing mechanism (49), which serve as toner supply means and are driven in rotation by driving means (not shown). The toner agitator (48) and the toner replenishing mechanism (49) supply toner, with stirring, from a toner hopper (45) to a developer container portion (46).

In the space between a photoconductor drum (20) and the toner hopper (45), there is disposed a development sleeve (41). The development sleeve (41), which is driven in rotation in the direction of the arrow by driving means (not shown), forms a magnetic brush composed of carrier particles (23), so that the magnetic sleeve (41) includes an inner magnet (not shown) which serves as magnetic field generating means and is disposed at an invariable position relative to the development apparatus (40).

A doctor blade (43) is integrally attached to an opposite side to the side to which a supporting case (44) is attached. In this example, the doctor blade (43) is disposed with a predetermined space being maintained between the tip of the doctor blade (43) and the outer peripheral surface of the development sleeve (41).

By use of this apparatus in an unlimited manner, the development method of the present invention is carried out as follows. The toner (21) fed from inside the toner hopper (45) by the toner agitator (48) and the toner replenishing mechanism (49) is transported into the developer container portion (46) and then stirred by a developer stirring mechanism (47), whereby the desired triboelectric/releasing charges are imparted to the toner. The toner is transported together with carrier particles (23) as a developer, borne on the development sleeve (41), to a position facing the outer peripheral surface of the photoconductor drum (20), so that only the toner (21) is electrostatically bonded to an electrostatic image formed on the photoconductor drum (21), whereby a toner image is formed on the photoconductor drum (20).

Figure 5:
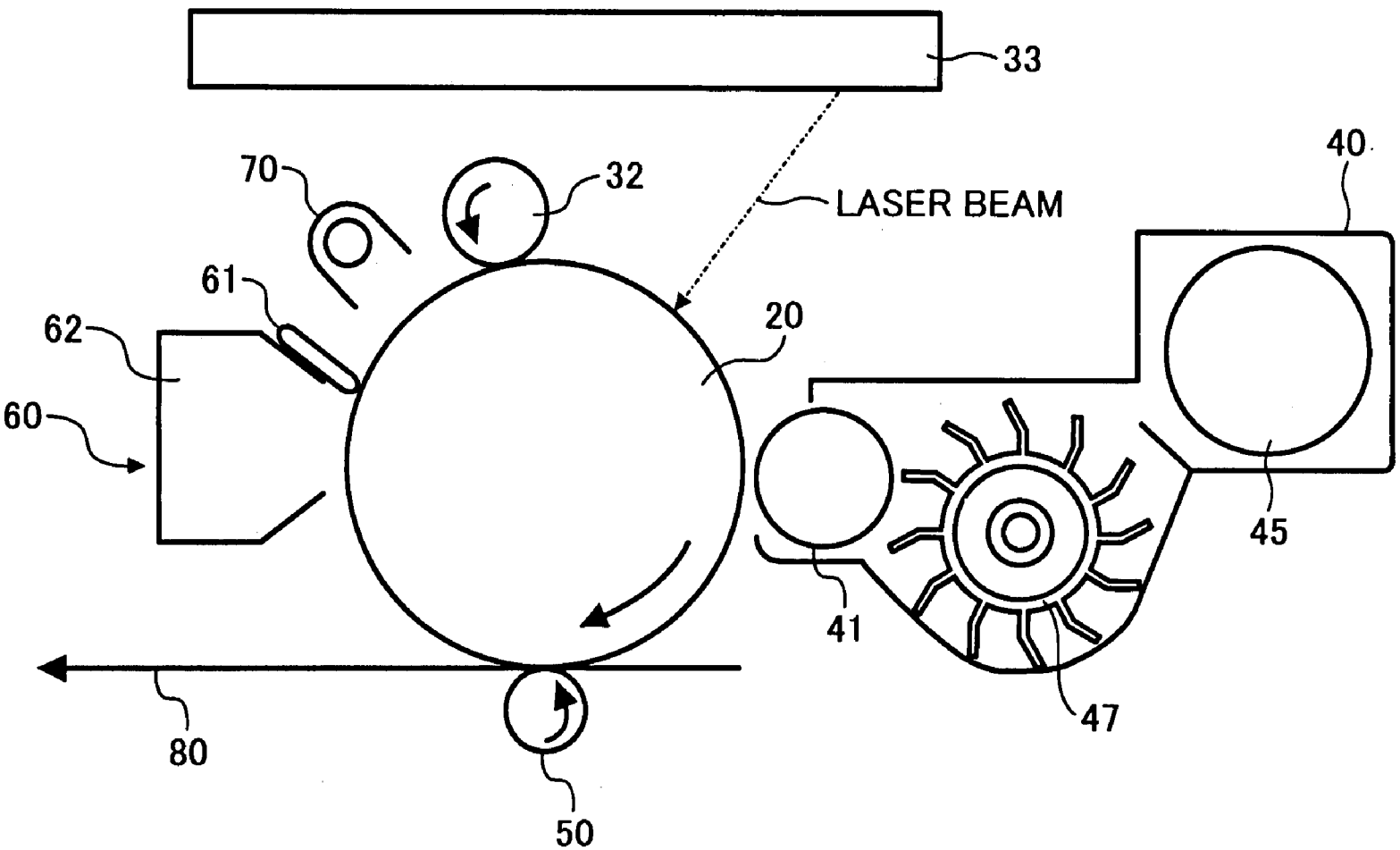
FIG. 5 is a schematic diagram of another embodiment of an apparatus for developing electrophotographic image according to the present invention.

FIG. 5 is the cross section which shows an image formation device which has such a developing device in section. A development (device) mechanism (40), a transfer mechanism (50), a cleaning mechanism (60) and a discharging lamp (70) image bearing member charging member (32) image exposure (33) are arranged to the drum-shaped image bearing member, that is, the surroundings of the photoconductor drum (20). The gap of about 0.2 mm is put, and the surface of the image bearing charging member (32) is in the condition of non-contact in case of this example as for the surface of the photoconductor (20).

When photoconductor (20) is charged by the surface of charging member (32), charging unevenness can be decreased by giving a photoconductor (20) a charging due to an electric field superimposed on an interchange not illustrated in charging member (32). The image forming method which has a developing method is done by the following movement. A series of processes of the image formation can be explained with a negative-positive process.

The image bearing member (20) that it is represented in the photoconductor (OPC) which has an organic photoconductive layer is quenched with a discharging lamp (70). The image bearing member was charged by charging member (32) such as a charging charger and a charging roller. Then the image bearing member was uniformly in a minus condition.

One image forming method useful herein follows.

(1). A laser beam is emitted by the semiconductor laser device, (2) and the laser beam scans the surface of the photoconductor which image bearing member by polygon mirror, which is rotated at high speed. The scan direction is in the rotation shaft direction. Then the latent image formed on the surface of the photoconductor is developed by the developer which comprises the toner particles and carrier, supplied to the surface of developing sleeve (41) which is a developer bearing member with e.g. a development device and a development means or development device (40), and the carrier particle, a toner visible image is formed. (The absolute value of the exposure department electric potential has a lower voltage than the absolute value of the non-exposure department electric potential.)

On the other hand, a transfer medium (for example, paper) (80) is sent from the loading paper mechanism (not illustrated), and the tip of the image and synchronism are taken with a cash register strike roller (not illustrated) of the up-down pair, and sent between the image bearing member (20) and the transfer member (50), and a toner figure is transferred.

After that, a transfer medium or a middle transfer medium (80) is separated from the image bearing member (20), and a transfer figure can provide it. The toner particles which remain on the image bearing member again are collected with a cleaning blade (61) as a cleaning member to the toner collection room (62) of the cleaning mechanism (60) inside. Collected toner particles are carried to a developing part and/or the toner supply part by the toner recycling means (not illustrated), and it may be reused.

Figure 6:
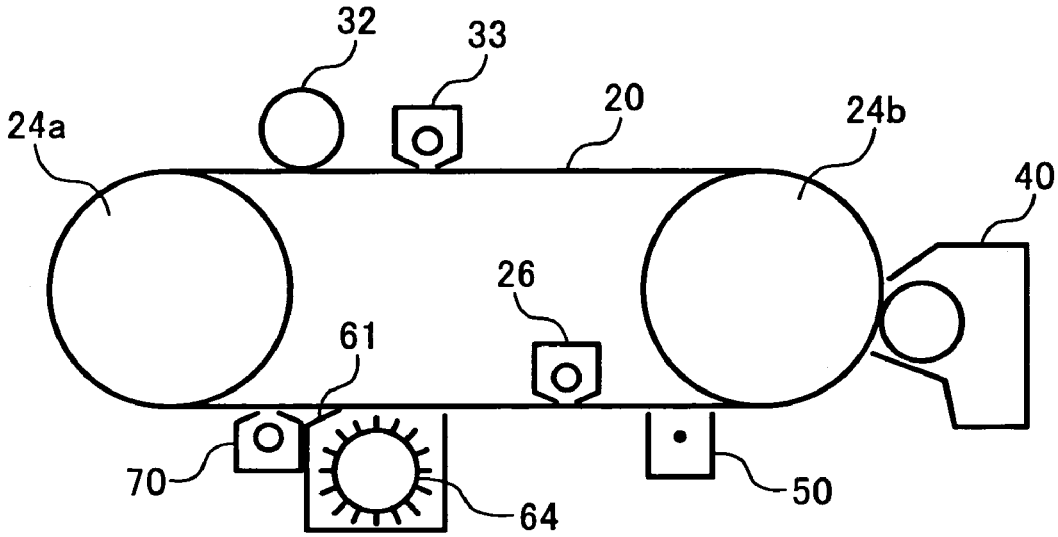
FIG. 6 is a schematic diagram of yet embodiment of an electrophotographic image forming apparatus according to the present invention.

FIG. 6 shows a process example in which another electrophotographic image forming method is used.

A sensitive layer comprises a photoconductor (20) on the conductive substrate. A photoconductor is driven by driving rollers ((24*a*) and (24*b*)).

The charging step used a charging roller (32);
The image exposure step used a light source (33);
The development step used a developing device (40);
The transfer step used a charging device (50);
The pre-cleaning light step used a light source (26);
The cleaning step used a brush-shaped cleaning means (64) and a cleaning blade (61);
The quenching step used a quenching lamp (70);
The above steps were repeated.

In the FIG. 6, photoconductor (20) was irradiated by the light for pre-cleaning light from the substrate side. (Of course the substrate is translucent in this case.)

Figure 7:
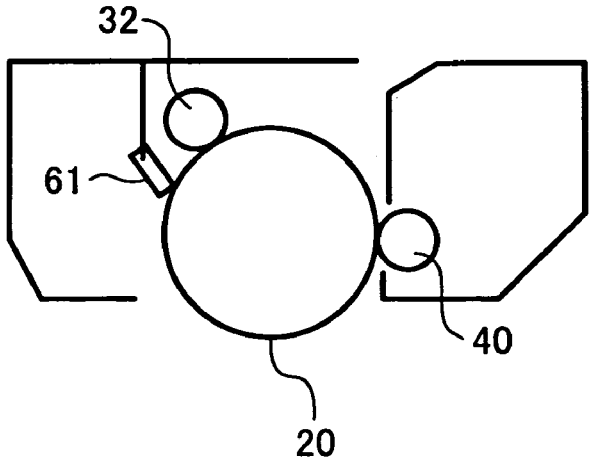
FIG. 7 is a schematic diagram of an embodiment of an electrophotographic image forming process cartridge according to the present invention.

FIG. 7 shows one example of the process cartridges of the present invention. Generally this process cartridge comprises developing means (40), the brush-shaped contact charging means of the carrier (32), the photoconductor (20) and the cleaning means of the cleaning blade (61). A process cartridge which is freely attachable to an electrophotographic image forming apparatus and detachable therefrom.

A covered layer A of high resistance is preferably formed on the surface of the core material of the carrier of the present invention. Therefore carrier adhesion due to the guidance (the influence of the bias voltage and the developing potential) of the charge is prevented, and the ground dirt is prevented.

Uniformity of the coating film of the carrier particles is preferred. So, covered layer A of a high resistance which is preferably uniform is formed in advance on the surface of the carrier core material. Further, when the covered layer B of a lower resistance was formed on the above covered layer A.

It is more preferable that the covered layer B having a lower resistance than that of the covered layer A be provided on the covered layer A, since the carrier particles with both of the covered layer A and the covered layer B can improve on the so-called carrier adhesion.

Covered carrier particles, each particle comprising a core material and a covered layer having a non-uniform thickness, provided on the surface of the core material, tend to cause "the carrier adhesion" more often than the conventionally known carrier particles.

In the covered carrier particle comprising a core material and a layer coated on the surface of the core material, when the coated layer has a non-uniform thickness, it could occur that portions with excessively thinner coated layers than in the other portions and even bare portions appear on the surface of the core material. When this takes place, the resistance of the carrier particles is significantly lowered as a whole since the core material itself has a low resistance.

In particular, in the case where the particle size of the carrier particles is small and the covered layer thereof includes portions with a non-uniform thickness, the carrier adhesion will be enhanced due to the influence of the bias voltage and the development potential.

In order to solve the above-mentioned problems, in the present invention, the covered layer A with higher resistance is provided on the surface of the carrier material so as to be substantially free of uncovered bare portions on the surface of the carrier material. Furthermore, another covered layer B with a higher resistance is provided on the covered layer A.

The thus fabricated carrier particles provided with both the covered layers A and B can significantly reduce the background smearing and the carrier adhesion.

It is preferable that the logarithm (LogRA) of the resistance value of the above high resistance covering layer A is (the direct current resistance of 500V) be greater than and equal 15.5 Ω cm.

It is preferable that the core material of the carrier be substantially covered with resin layer.

When the logarithm (LogRA) of the resistance value of the enveloping layer A is less than 15.5 Ω cm, the carrier deposition shows a tendency to increase.

It can know that the resistance of the coated layer which is close to the core material is high by analyzing the distribution of the resistance adjustment medicine (for example, in case of carbon, the analysis of carbon C) in the depth direction of the coated layer.

A method of the specific analysis is now described.

A coated carrier is evaporated with Pt—Pd (platinum-palladium). (Thickness of Pt—Pd is about 12 nm). Furthermore, above the carrier is evaporated with W (tungsten). A sample piece of the thickness of 100 nm is made by using a convergent ion beam device (Focus-Ion-Beam FB-2000 manufactured by Hitachi, Ltd.). Then the sectional area becomes the biggest surface at the sample piece. The above sample having thickness 100 nm is observed by Scanning TEM (Scanning type permeation electron microscope: HD-2000 (manufactured by Hitachi, Ltd.)).

Next, an any point of thickness direction of films are analyzed with an energy dispersive X-ray fluorescence analysis device (Energy-Dispersive-X-ray Fluorescece pectrometer). (For example, the carbon atom analysis).

The resin of the low resistance layer B or the high resistance layer A is used for the manufacture of the possible resin carrier as and which is known well can be used in the present invention.

The carrier of the present invention is preferably prepared by providing a resin layer on the surface of the particles of magnetic core material. As resin materials for forming the resin layer, a silicone resin including units of one or more of the formulas represented below is favorably used in the present invention;

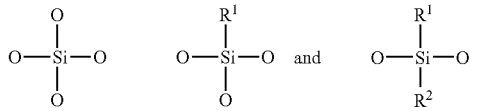

wherein $R^1$ indicates a hydrogen atom, a halogen atom, a hydroxyl group, a methoxy group, a lower alkyl group having 1 to 4 carbon atoms or a aryl group such as phenyl group and tryl group, $R^2$ indicates a lower alkylene group having 1 to 4 carbon atoms or a arylene group such as phenylene group and trylene group.

Preferably, $R^1$ is aryl group having from 6 to 20 carbon atoms, more preferably $R^1$ is aryl group having from 6 to 14 carbon atoms. As for this aryl group, the aryl group of the chain polycyclic aromatic hydrocarbon such as the aryl group of the condensed polyaromatic hydrocarbon such as a naphthalene, a phenanthrene and an anthracene and a biphenyl and a terphenyl and so on is included except for the aryl group of the benzene.

The above aryl group may be combine various substitution groups.

The silicone resin may be a straight silicone resin or a modified silicone resin. Illustrative of straight silicone resins are KR271, KR272, KR282, KR252, KR255, KR152 (products of Shinetsu Chemical Industry Co., Ltd.), SR2400 and SR2406 (products of Toray Dow Corning Silicone Inc.). The modified silicone resin may be, for example, epoxy-modified silicone, acryl-modified silicone, phenol-modified silicone, urethane-modified silicone, polyester-modified silicone or alkyd-modified silicone.

Furthermore, illustrative of modified silicone resins are ES-1001N (epoxy-modified), KR-5208 (acryl-modified), KR-5203 (polyester-modified), KR-206 (alkyd-modified), KR-305 (urethane-modified) (above are products of Shinetsu Chemical Industry Co., Ltd.), SR2115 (epoxy-modified) and SR2110 (alkyd-modified) (products of Toray Dow Corning Silicone Inc.).

The carrier core particles preferably are each coated with a resin layer. Any binder customarily used for coating a core material of carriers may be employed in the present invention. Examples of the binder include silicone resins, polystyrene resins (e.g. polystyrene, chloro polystyrene, poly-α-methyl styrene, styrene-chloro styrene copolymers, styrene-propylene copolymers, styrene-butadiene copolymers, styrene-vinyl chloride copolymers, styrene-maleic acid copolymers, styrene-acrylate copolymers (acrylate may be for example methyl acrylate, ethyl acrylate, butyl acrylate, octyl acrylate or phenyl acrylate), styrene-methacrylate copolymers (methacrylate may be for example methyl methacrylate, ethyl methacrylate, butyl methacrylate, octyl methacrylate or phenyl methacrylate), styrene-methyl .alpha.-chloro acrylate copolymers and styrene-acrylonitrile-acrylate copolymers), epoxy resins, polyester resins, poly olefin resins (e.g. polyethylene resins and polypropylene resins), ionomer resins, polyurethane resins, ketone resins, ethylene-ethyl acrylate resins, xylene resins, polyamide resins, phenol resins, polycarbonate resins, melamine resins, polyacrylic resins, polymethacrylic resins, polyether resins, poly sulfinic acid resins, poly butyral resins, urea resins, urethane-urea resins, teflon resins, copolymers thereof including block copolymers and graft copolymers, and mixtures thereof.

The resin layer may be formed by any conventional method such as spray drying, immersion, powder coating, fluidized bed coating. The fluidized bed coating is preferably used for forming a resin layer having a uniform thickness. The resin layer preferably has a thickness of 0.02–1.0 μm, more preferably 0.03–0.8 μm.

Examples of aminosilane coupling agents useful herein are given below together with the molecular weight thereof: Preferably, amount of the aminosilane coupling agents is range of from 0.001 to 30% by weight of the resin layer thereof:

| | |
|---|---|
| $H_2N(CH_2)_3Si(OCH_3)_3$ | MW: 179.3 |
| $H_2N(CH_2)_3Si(OC_2H_5)_3$ | MW: 221.4 |
| $H_2N(CH_2)_3Si(CH_3)_2OC_2H_5$ | MW: 161.3 |
| $H_2N(CH_2)_3SiCH_3(OC_2H_5)_2$ | MW: 1913 |
| $H_2N(CH_2)_2NHCH_2Si(OCH_3)_3$ | MW: 194.3 |
| $H_2N(CH_2)_2NH(CH_2)_3SiCH_3(OCH_3)_2$ | MW: 206.4 |
| $H_2N(CH_2)_2NH(CH_2)_3Si(OCH_3)_3$ | MW: 224.4 |
| $(CH_3)_2N(CH_2)_3SiCH_3(OC_2H_5)_2$ | MW: 219.4 |
| $(C_4H_9)_2N(CH_2)_3Si(OCH_3)_3$ | MW: 291.6 |

In developer of the present invention comprising carrier and toner, toner charge to mass ratio, when used in such an amount as to provide a covering ratio of 50%, is in the range of from 15 μc/g to 35 μc/g. When toner charge to mass ratio is in the range of from 15 μc/g to 35 μc/g, the developer is excellent in smearing of the background and carrier deposition.

The present invention developer comprising carrier and toner preferably has a coverage ratio by the toner for the carrier of from 10% to 90%, preferably from 20% to 80%. Moreover, in the developer of the present invention, when the coverage ratio by the toner for the carrier is 50%, toner charge to mass ratio is preferably in the range of from 10 μc/g to 50 μc/g, more preferably from 15 μc/g to 35 μc/g. When toner charge to mass ratio is in a range of less than 10 μc/g, the smear of background and toner scatter increases. Moreover, when the toner charger is in a range of more than 50 μc/g, the carrier deposition increases. When toner charge to mass ratio is in a range of less than 35 μc/g, the carrier deposition is excellent.

The term "covering ratio" used in the present specification refers to a proportion of toner particles of the developer relative to carrier particles of the developer in terms of percentage calculated by the following equation:

$$\text{Covering Ratio (\%)}=(Wt/Wc)\times(\rho c/\rho t)\times(Dc/Dt)\times(1/4)\times 100$$

wherein

Wt: the toner weight (g).

Wc: the carrier weight (g).

ρc: specific gravity of the carrier ($g/cm^3$).

ρt: specific gravity of the toner ($g/cm^3$).

Dc: weight average particle diameter of the carrier (μm).

Dt: weight average particle diameter of the toner (μm).

The toner preferably has a weight average particle diameter of not greater than 5.0 μm. The use of such a small particle size toner in conjunction with the above carrier can give high quality images with good dot image reproducibility.

The toner generally comprises a binder resin such as a thermoplastic resin, a coloring agent and, optionally, additive particulates such as a charge controlling agent and a releasing agent. The toner may be prepared by any suitable known method including, for example, polymerization, pulverization and classification with air classifier. Both magnetic and non-magnetic toner may be used.

The binder resins include polystyrene resins, polyester resins, epoxy resins, polymethyl acrylate, polybutyl methacrylate, polyvinylchloride, polyvinylacetate, polyethylene, polypropylene, polyurethane, polyvinylbutyral, polyacrylic resins, rosin, modified rosin, terpene resins, phenol resins, aliphatic resins, aliphatic hydrocarbon resins, aromatic petroleum resins, chlorinated paraffin and paraffin wax.

Examples of the polystyrene resins include polystyrene, polyvinyltoluene; and styrene-copolymers such as styrene-p-chlorostyrene copolymer, styrene-polypropylene copolymer, styrene-vinyltoluene copolymer, styrene-methylacrylate copolymer, styrene-ethylacrylate copolymer, styrene-butylacrylate copolymer, styrene-.alpha.-methylchlormethacrylate copolymer, styrene-acrylonitrile copolymer, styrene-vinylmethylether copolymer, styrene-vinylmethylketone copolymer, styrene-butadiene copolymer, styrene-isoprene copolymer, styrene-maleic acid copolymer, and styrene-maleate copolymer.

The polyester resin which is a polycondensation product of a polyhydric alcohol and a polybasic acid can reduce melt viscosity of the toner while maintaining storage stability thereof. Examples of polyhydric alcohols include diols such as polyethylene glycol, diethylene glycol, triethylene glycol 1,2-propylene glycol, 1,3-propylene glycol, 1,4-propylene glycol, neopentyl alycol, and 1,4-butenediole; bisphenol A etherificated such as 1,4-bis(hydroxymethyl)cyclohexane, hydrogenated bisphenol A, bis(polyoxyethylene phenyl)propane, bis(polyoxymethylene phenyl)propane; dihydric alcohol monomers formed by the substitution thereof with a saturated or unsaturated hydrocarbon group having 3–22 carbon atoms, and other dihydric alcohol monomers; trihydric or higher alcohol monomers such as sorbitol, 1,2,3,6-hexane tetrol, 1,4-sorbitan, pentaerythritol, dipentaerythritol, tripentaerythritol, cane sugar, 1,2,4-butanetriole, 1,2,5-pentanetriole, glycerol, 2-methyl propanetriole, 2-metyl-1,2,4-butanetriole, trimetylolethane, trimetylolpropane, and 1,3,5-trihydroxymethylbenzene.

Examples of the polybasic carboxylic acid include: monocarboxylic acid such as palmitic acid, stearic acid, and oleic acid; dibasic organic acid monomers such as maleic acid, fumalic acid, mesaconic acid, citraconic acid, terephthalic acid, cylclohexane dicarboxycylic acid, succinic acid, adipic acid, sebatic acid, malonic acid, dibasic acid monomers formed by the substitution thereof with a saturated or unsaturated hydrocarbon group having 3–22 carbon atoms, anhydrides thereof, and a dimer formed between low alkylester and linoleic acid; tribasic or higher acid monomers such as 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxypropane, and tetra(methylenecarboxyl)methane, 1,2,7,8-octanetetracarboxylic acid Enbol timer acid and anhydrides thereof.

Examples of the epoxy resins include polycondensation products between bisphenol A and epochlorohydrin, which are commercially available as Epomick R362, R364, R365, R366, R367 and R369 from Mitsui Petrochemical Co. Japan; YD-011, YD-012, YD-014, YD-904 and YD-017 from Toto Chemical Co. Japan; and Epocoat 1002, 1004 and 1007 from Shell Chemical Japan Co.

Illustrative of suitable coloring agents are carbon black, lamp black, iron black, ultramarine, nigrosine, aniline blue, phthalocyanine blue, Hansa Yellow C, Rhodamine 6G, lake, chalcone blue, Chrome Yellow, quinacridone, Benzidine Yellow, Rose Bengale, triallylmethane dyes, mono-azo or diazo pigments, and other known dyes and pigments. These materials may be used individually or in combination.

In the case of a magnetic toner, fine particles of ferromagnetic materials such as iron and cobalt, magnetite, hematite, Li ferrite, Mn—Zn ferrite, Cu—Zn ferrite, Ni—Zn ferrite, Ba ferrite and Mn ferrite may be incorporated into the toner.

For the purpose of controlling triboelectricity of the toner, a charge controlling agent may be incorporated into the toner. Examples of the charge controlling agent include organic metal complexes and chelate compounds such as a metal complex of a mono-azo dye; humic or nitrohumic acid or a salt thereof; metal complexes (e.g. Co, Cr, and Fe metal complexes) of aromatic hydroxycarboxylic or dicarboxylic acids such as salicylic acid, naphthoic acid and dicarboxylic acid; a quartemary ammonium compound; or an organic dye such as triphenylmethane dyes and nigrosine dyes.

If desired, the toner can contain a releasing agent, such as a low molecular weight polypropylene, a low molecular weight polyethylene, camauba wax, micro-crystalline wax, jojoba wax, rice wax or montan wax, and these waxes are used alone or in combination.

The toner also may contain one or more additives if desired. It is required for excellent quality of image to provide to the toner with a sufficient fluidity. For this purpose, to the toner an exterior addition of fluidity improving agent such as finely divided powders of metallic oxides which are hydrophobic-treated or fine powder of lubricant to the toner is effective, and additives such as metallic oxide, finely divided powders of organic resin and metallic soaps may be employable. Illustrative examples thereof are a lubricant such as poly(tetrafluoro-ethylene) resin and zinc stearate, an abrasive such as cerium oxide or silicon carbide, a fluidity improving agent consisting of inorganic oxide such as $SiO_2$ and $TiO_2$ powders which are having been hydrophobic treated, a material known as anti-caking agent such as colloidal silica, aluminum oxide, and hydrophobic treated materials therefrom, and in particular hydrophobic silica is favorable for improving the fluidity of the toners. It is desirable that the toner have sufficient fluidity and can be transferred to a latent image bearing surface without fail. To this end, preferred fluidity improving agents such as hydrophobic metal oxide powders (e.g. hydrophobic silica or titania), lubricants such as organic polymer powder (e.g. polytetrafluoroethylene) or metal soaps (e.g. zinc stearate), polishing agents (e.g. cerium oxide or silicon carbide), and caking-preventing agents may be added into the toner.

The toner used in the present invention preferably has a weight average particle diameter (Dt) range of from 9.0 μm to 3.0 μm, preferably from 7.5 μm to 3.5 μm.

A ratio of the toner for carrier ranges from 2 to 25 weight parts, preferably form 3 to 20 weight parts of the toner per 100 weight parts of the carrier.

The invention method of developing is a method of developing a latent image by using the present invention carrier, the toner and the developer.

In this method, when AC voltage and DC voltage are superimposed from the outside to be applied, the image has enough density. Especially, the graininess of the highlight becomes excellent. Furthermore, when the developing bias is used only DC voltage, the condition improves background smearings, carrier deposition and effective edge. As the margin of smear of background increases, it is possible for us to make a the covering rate of toner larger. So toner charge to mass ratio and developing bias can be decreased, and consequently image density get higher.

The developer according to the present invention can be used for developing an electrostatic latent image with any known image forming device. In this case, it is preferred that the developer be supported on a developing roller or sleeve to which an alternating current voltage is applied as a developing bias for reasons of obtaining a high image density with small variation of dot diameters and with good highlight reproducibility. The AC voltage may be overlapped with a DC voltage. A preferred image forming apparatus comprises a photoconductor, a developer as defined herein, the developing sleeve and the distance of the developing sleeve and the photoconductor having less than 0.4 mm, and a developing bias applied with an AC voltage and/or DC voltage.

Having generally described this invention, further understanding can be obtained by reference to following specific examples which are provided herein for the purpose of illustration only and are not intended to be limiting. In the description in the following examples, the numbers represent weight ratios unless otherwise specified.

EXAMPLES

Preparation of Toners

Example 1

[Preparation of Toner 1]

| | |
|---|---|
| Polyester resin | 100 parts |
| Magenta dye of quainacridone type | 3.5 parts |
| Fluorine-containing quaternary ammonium salt | 4 parts |

Above ingredients were thoroughly mixed using a blender then melted and kneaded buy a bi-axial extruder, allowed to cool, coarsely pulverized by a cutter mill, then finely pulverized by a jet pneumatic fine mill and classified by a pneumatic classifier, thus obtained a mother toner particles having 6.8 μm of weight average diameter, 1.20 g/cm$^3$ of specific gravity.

To 100 parts of this mother toner was added by 0.8 parts of hydrophobic silica fine particles (R 972; made by Aerosil Japan Co. Ltd.) to obtain Toner I.

[Preparation of Toner 2]

Toner II having 4.6 μm of weight average diameter, 1.20 g/cm$^3$ of specific gravity was prepared from steps of preparing a mother toner by similar method as that of described Preparation of Toner 1, then adding 1.2 parts of the hydrophobic silica particles ((R 972; made by Aerosil Japan Co. Ltd.).

Preparation of Carriers

[Preparation of Carrier 1]

Silicon resin (SR241 made by Toray Dow-coming Ltd.) was diluted to a silicon resin solution (containing 5% of solid).

This solution was coated onto 5 kg of Carrier Core (a) having characteristics shown in the Table I below (Cu—Zn type ferrite having 57 emu/g of magnetization at 1 KOe) by using a fluidized bet-type of coating apparatus at rate of approximately 30 g/min, in an atmosphere at 90° C., and the coated were followed by heating for two hours at 230° C., thus Carrier A having 5.0 g/cm$^3$ of specific gravity and 0.35 μm of coated layer thickness was obtained. The thickness of the coated layer was controlled by adjusting the amount of the coating liquid introduced.

[Preparation of Carrier 2]

Same method as that of described in Preparation of Carrier 1 was repeated with exception of using Carrier Core (b) shown in Table I, to obtain Carrier B having 0.35 μm of coated layer thickness and 5.0 g/cm$^3$ of specific gravity.

[Preparation of Carrier 3]

Same method as that of described in Preparation of Carrier 1 was repeated with exception of using Carrier Core (c) shown in Table I, to obtain Carrier C having 0.34 μm of coated layer thickness and 5.0 g/cm$^3$ of specific gravity.

[Preparation of Carrier 4]

Same method as that of described in Preparation of Carrier 1 was repeated with exception of using Carrier Core (d) shown in Table I, to obtain Comparative Carrier D having 0.36 μm of coated layer thickness and 5.0 g/cm$^3$ of specific gravity.

[Preparation of Carrier 5]

Same method as that of described in Preparation of Carrier 1 was repeated with exception of using Carrier Core (e) shown in Table I, to obtain Comparative Carrier E having 0.35 μm of coated layer thickness and 5.0 g/cm$^3$ of specific gravity.

[Preparation of Carrier 6]

Same method as that of described in Preparation of Carrier 1 was repeated with exception of using Carrier Core (f) shown in Table I, to obtain Comparative Carrier F having 0.34 μm of coated layer thickness and 5.0 g/cm$^3$ of specific gravity.

[Preparation of Carrier 7]

Same method as that of described in Preparation of Carrier 1 was repeated with exception of using Carrier Core (g) shown in Table I, to obtain Carrier G having 0.35 μm of coated layer thickness and 5.0 g/cm$^3$ of specific gravity.

[Preparation of Carrier 8]

Same method as that of described in Preparation of Carrier 1 was repeated with exception of using Carrier Core (h) shown in Table I (MnMgSr ferrite having 73 emu/g of magnetization at 1 KOe), to obtain Carrier H having 0.37 μm of coated layer thickness and 4.9 g/cm$^3$ of specific gravity.

[Preparation of Carrier 9]

Same method as that of described in Preparation of Carrier 1 was repeated with exception of using Carrier Core (i) shown in Table I (Mn ferrite having 80 emu/g of magnetic moment at 1 KOe), to obtain Carrier 1 having 0.35 μm of coated layer thickness and 5.1 g/cm$^3$ of specific gravity.

[Preparation of Carrier 10]

Same method as that of described in Preparation of Carrier 1 was repeated with exception of using Carrier Core (j) shown in Table I (magnetite having 81 emu/g of magnetization at 1 KOe), to obtain Carrier J having 0.36 μm of coated layer thickness and 5.3 g/cm$^3$ of specific gravity.

[Preparation of Carrier 11]

Same method as that of described in Preparation of Carrier 1 was repeated with exception of using Carrier Core (k) shown in Table I (Cu—Zn ferrite having 58 emu/g of magnetization at 1 KOe, 2.43 g/cm$^3$ of bulk density), to obtain Carrier K having 0.36 μm of coated layer thickness and 5.1 g/cm$^3$ of specific gravity.

[Preparation of Carrier 12]

Silicon resin (SR2411 made by Toray Dow-coming Ltd.) was diluted to a silicon resin solution. A carbon black (Ketjen Black EC-DJ600 made by Lion Akzo Co. Ltd) of 7 wt % for the solid resin weight were added into solution, which then dispersed for 60 minutes by a ball mill.

The obtained solution (containing 5% of solid) was coated onto 5 kg of Carrier Core (b) having characteristics shown in Table I using a fluidized bed-type coating apparatus at a supply rate of 30 g/min., atmospheric condition was at 100° C. After coated they were heated for two hours at 250° C., thus Carrier L having 0.35 μm of coated layer thickness and 5.0 g/cm$^3$ of specific gravity was obtained.

[Preparation of Carrier 13]

A silicone resin was diluted, and a silicone resin solution (containing 2.5% of solid) was made.

Next, the above silicone resin solution was applied on 5 Kg of each particle surface of carrier core material (b) using the flowing floor type coating device under an atmosphere of 90° C. at the rate of about 15 g/min. A small quantity was heated at 240° C. for 2 hours.

When a film thickness was measured by the fluorescence X-ray, the high resistance covering layer A which consisted of the silicone resins of 0.08 μm was formed.

Furthermore, Same method as that of described in Preparation of Carrier 12 was repeated with exception of using the above core coverd with silicon resin of 0.08 μm, to obtain Carrier M having 0.37 μm of coated layer thickness and 4.9 g/cm$^3$ of specific gravity.

The electric volume resistivity of first step core was 15.7 Ω cm(=LogR), and that of Carrier M was 13.6 Ω cm(=LogR).

[Preparation of Carrier 14]

Silicon resin (SR2411 made by Toray Dow-coming Ltd.) was diluted to a silicon resin solution (containing 5% of solid).

To the solution was added an amino silane coupling agent having a structure shown by $H_2N—(CH_2)_3—Si—(CH_2H_5)_3$ at ratio of 2.0 wt % for the solid in the solution.

Then the solution was coated onto 5 kg of Carrier Core (b) having characteristics shown in the Table I by using a fluidized bed-type of coating apparatus at rate of approximately 30 g/min, in an atmosphere at 90° C., followed by heating for two hours at 230° C., thus Carrier N having 5.0 g/cm$^3$ of specific gravity and 0.34 μm of coated layer thickness was obtained. As usual, controlling of the thickness of the coated layer was accomplished by adjusting the amount of the coating liquid introduced.

[Preparation of Carrier 15]

Same method as that of described in Preparation of Carrier 2 was repeated with exception of adopting the heating temperature of 300° C. after coating, to obtain Carrier 0 having 0.35 μm of coated layer thickness and 5.0 g/cm$^3$ of specific gravity.

[Preparation of Carrier 16]

5 kg of a carrier core material (d) shown in table 1 was vibrated for 5 min to classify using a vibration screen classifier equipped with an ultrasonic wave generator. The mesh of vibration screen classifier is adopted 350 mesh.

The core material which passed through the mesh was vibrated for 5 min with a vibration screen classifier with the ultrasonic vibration device that set 635 mesh, and the carrier core material (1) which had the nature shown in the table 1 was obtained.

The vibration screen classifier is a classifier shown in FIG. 1, which is a sieving apparatus equipped with an ultrasonic wave generator (transducer) (8) generating ultrasonic waves having frequency of 36 KHz as a vibrator which is provided on a resonator ring (6) contacted with a metal screen (5) having 70 cm diameter and 350 mesh or 635 mesh which is supported by a frame (9). The metal screen (5) is provided in a cylindrical container (2) which is supported by a base member (4) through springs (3). There is provided a vibrating motor which is not shown in the FIG. 1, while generates a high frequency electric current by driving thereof, and generated electric current is, via cable (7), transferred to the ultrasonic wave generator (8) fixed in the resonator ring (6), thereby ultrasonic waves are generated. By the ultrasonic waves, the resonator ring (6) is vibrated, thereby the metal mesh (5) is vibrated in perpendicular direction to the surface of the screen mesh (5). Thus classified Carrier Core Material was recovered as Carrier Core (1) from the upside of the screen mesh (5). There was no clogging of mesh (5). By using the vibration screen classifier, content ratio of small size less than 20 μm was able to decrease from 8.0 weight % to 1.8 weight %, with yielding of 92 weight %. Using this Carrier Core material, Coated Carrier P was obtained by the same method as that of described in Preparation of Carrier A.

[Preparation of Carrier 17]

Carrier D was classified (removal of finer particles) by using the same method as that of described in Preparation of Carrier 16(350 mesh→635 mesh). After classified Carrier D, Carrier D' having characteristics shown in the Table I-2 was obtained.

In Carrier D' as a classified resultant, content ratio of small size less than 20 μm was able to decrease from 8.1 weight % of Carrier D to 2.5 weight %.

No obstruction of the mesh occurred during the sieve management.

[Preparation of Developers and Evaluations of the Same]

Various developers were prepared using Toners I and II obtained from Preparation of the Toners 1 and 2, and Carrier A to D' obtained from Preparation of Carrier 1 to 17.

Also, images were reproduced using the various developers, and many qualities of the images were identified and characteristics such as reliabilities thereof and other performance characteristics were examined.

The images were reproduced under the following conditions using Imagio Color 4000 (registered trademark of a copy machine having digital color image printing function manufactured by Ricoh Co. Ltd.)

Developing gap (photosensitive member-developing sleeve); 0.35 mm

Doctor gap (developing sleeve-doctor); 0.65 mm

Linear speed of photosensitive member; 200 mm/sec.

Ratio of liner speeds (of developing sleeve/of photosensitive member)=1.80

Imprinting density of the dots (pixels); 600 dpi

Charged electric potential (Vd); −600V

Electric potential (VI) at image part (solid area) presented by light irradiation;

−150V

Developing biased potential; DC-500V/AC bias component of 2 KHz, −100V to −900V, and 50% duty)

Evaluations of the images reproduced were conducted on transferring paper sheets, while evaluations of carrier depositions were conducted by observation of the states on photosensitive member after developed and before transferring.

Adopted examination methods in following Examples were as below.

(1) Image density; 5 images located in central parts of every 30 mm×30 mm solid image areas reproduced in above described conditions were measured by X-Rite938 spectral densitometer, to calculate an average value of density.

(2) Evaluation of uniformity of highlight area; Granularity (range of lightness=50 to 80) defined by Equation 5 was measured.

$$\text{Granularity}=\exp\ (aL+b)\int((WS(f))^{1/2}VTF(f)df \qquad \text{Equation 5}$$

Wherein, the L is average lightness, the f means spatial frequency (cycle/mm), the WS(f) means power spectrum of lightness changes, the VTF(f) means visual spatial modulation transfer function, and the a, the b are coefficients, respectively.

And the measured values were allotted to following Grades (Grade 10 is the best)

| | |
|---|---|
| Grade 10; | −0.10 to 0 |
| Grade 9; | 0 to 0.05 |
| Grade 8; | 0.05 to 0.10 |
| Grade 7; | 0.10 to 0.15 |
| Grade 6; | 0.15 to 0.20 |
| Grade 5; | 0.20 to 0.25 |
| Grade 4; | 0.25 to 0.30 |
| Grade 3; | 0.30 to 0.40 |
| Grade 2; | 0.40 to 0.50 |
| Grade 1; | more than or equal to 0.5 |

(3) Smear of background area; Background areas suffered from the above described image reproducing conditions were evaluated by following 10 Grades (Grade 10 is the best).

Evaluation is made by counting the number of deposited toners on the background areas of the transferring paper sheets, to calculate the number of deposited toners per 1 $cm^2$. Relationship between Grades and toner number deposited (per 1 $cm^2$) were as below.

| | |
|---|---|
| Grade 10; | 0 to 36 |
| Grade 9; | 37 to 72 |
| Grade 8; | 73 to 108 |
| Grade 7; | 109 to 144 |
| Grade 6; | 145 to 180 |
| Grade 5; | 181 to 216 |

-continued

| | |
|---|---|
| Grade 4; | 217 to 252 |
| Grade 3; | 253 to 288 |
| Grade 2; | 289 to 324 |
| Grade 1; | more than or equal to 325 |

Carrier deposition; Generation of carrier depositing causes the flaws on photosensitive drum or fixing roller, and therefore decreases image density. As only one part of deposited carriers are in general transferred to the transferring paper, the carrier deposition states were directly observed on photosensitive drum. Generation of carrier depositions are varied by image patterns, therefore the improbabilities of carrier depositions were evaluated by following manner.

The image pattern of 2 dot line (1001 pi/inch) was made in the vice-scanning direction. A DC bias 400V was given to it, and it transferred with number (area was 100 $cm^2$) adhesive tape of the carrier that it was developed and which stuck between the lines of 2 dot line. That number was moved in rank as follows and indicated. Rank 10 was made the best condition.

| | |
|---|---|
| Grade 10; | 0 |
| Grade 9; | 1 to 10 |
| Grade 8; | 11 to 20 |
| Grade 7; | 21 to 30 |
| Grade 6; | 31 to 50 |
| Grade 5; | 51 to 100 |
| Grade 4; | 101 to 300 |
| Grade 3; | 301 to 600 |
| Grade 2; | 601 to 1000 |
| Grade 1; | more than or equal to 1000 |

(4) Smear after 20 K run; Magenta Toners I or II which were being gradually consumed, a letters image chart having 6% ratio of image area were reproduced on 20 K paper sheets, to evaluate smears in 20,000 times run by following 10 Grades. Evaluation is made by counting the number of deposited toners on the background areas of the transferring paper sheets, to calculate the number of deposited toner per 1 $cm^2$. Relationships between Grades and toner number deposited (per 1 $cm^2$) were as below.

| | |
|---|---|
| Grade 10; | 0 to 36 |
| Grade 9; | 37 to 72 |
| Grade 8; | 73 to 108 |
| Grade 7; | 109 to 144 |
| Grade 6; | 145 to 180 |
| Grade 5; | 181 to 216 |
| Grade 4; | 217 to 252 |
| Grade 3; | 253 to 288 |
| Grade 2; | 289 to 324 |
| Grade 1; | more than or equal to 325 |

Example 1

Toner I of 11.4 parts was added to 100 parts of Carrier A, and they were agitated using a ball mill for 20 minutes. The toner concentration of the developer was 11.3 wt %. When Covering ratio to the Carrier A by Toner I was 50%, toner charge to mass ratio of Toner I was −39 μc/g.

Next, image quality was identified using Imagio Color 4000 (registered trademark of a copy machine having digital color image printing function manufactured by Ricoh Co. Ltd.), which was set to above described conditions, and with above described evaluation manner.

Image density was 1.59, uniformity of highlight was Grade 7, Smear of background was Grade 7, Carrier deposition was Grade 5. Smear test by 20 K run was then followed using an image chart having 6% ratio of letters image area. After 20 K runs, the smear check revealed an excellent Grade 6, hence a high quality image was obtained.

Comparative Example 1

Toner I of 13.1 parts was added to 100 parts of Carrier D, and they were agitated using a ball mill for 20 minutes. The toner concentration of the developer was 11.6 wt %. When Covering ratio to the Carrier D A by Toner I was 50%, toner charge to mass ratio of Toner I was −38 μc/g.

Evaluation of image quality was conducted in same method as that of in Example 1, using an Imagio Color 4000. Image density was 1.63, however, uniformity of highlight was Grade 3, Smear of background was Grade 3, Carrier deposition was Grade 2 were produced.

Smear test by 20K run was then followed using an image chart having 6% ratio of letters image area. After 20,000 runs, smear check revealed a Grade 2 hence a worse quality of image was obtained.

Examples 2 to 15 and Comparative Examples 2 to 3

The same evaluations as that described in Example 1, except that the combination of Toners and Carriers were varied as shown in the Table 2. Obtained results are shown in Table 1-1 and 1-2.

Example 16

The same evaluations as that described in Example 1, except that toner of example 1 was replaced with toner of example 2, and Developing biased used DC-450V. The evaluation result was shown in the Table 2.

TABLE 1-1

| | characteristics of carriers | | | | | | | | |
|---|---|---|---|---|---|---|---|---|---|
| preparation of carriers | carrier | Core material | weight average diameter (μm) | content ratio (wt %) of small particles less than 20 μm diameter | content ratio (wt %) of particles less than 36 μm diameter | content ratio (wt %) of particles less than 44 μm diameter | magnetization of carrier (emu/g, 1K Oe) | composition of core | bulk density (g/cm$^3$) |
| Pre. 1 | A | Core (a) | 28.0 | 6.7 | 92.0 | 98.1 | 57 | Cu—Zn ferrite | 2.22 |
| Pre. 2 | B | Core (b) | 28.2 | 4.3 | 94.7 | 99.1 | 57 | Cu—Zn ferrite | 2.20 |
| Pre. 3 | C | Core (c) | 24.2 | 4.4 | 96.0 | 99.5 | 57 | Cu—Zn ferrite | 2.18 |
| Pre. 4* | D | Core (d) | 28.1 | 8.0 | 93.0 | 98.1 | 57 | Cu—Zn ferrite | 2.17 |
| Pre. 5* | E | Core (e) | 29.3 | 4.6 | 82.3 | 93.6 | 57 | Cu—Zn ferrite | 2.19 |
| Pre. 6* | F | Core (f) | 28.3 | 8.6 | 85.1 | 95.0 | 57 | Cu—Zn ferrite | 2.17 |
| Pre. 7 | G | Core (g) | 28.3 | 2.4 | 94.6 | 99.0 | 57 | Cu—Zn ferrite | 2.21 |
| Pre. 8 | H | Core (h) | 28.4 | 4.1 | 95.1 | 99.3 | 73 | Mn—Mg—Sr ferrite | 2.20 |
| Pre. 9 | I | Core (i) | 28.2 | 3.9 | 95.3 | 99.1 | 80 | Mn ferrite | 2.19 |
| Pre. 10 | J | Core (j) | 28.0 | 4.2 | 94.9 | 99.0 | 81 | Magnetite | 2.22 |
| Pre. 11 | K | Core (k) | 28.1 | 4.0 | 94.5 | 98.8 | 58 | Cu—Zn ferrite | 2.43 |
| Pre. 12 | L | Core (b) | 28.2 | 4.3 | 94.7 | 99.1 | 57 | Cu—Zn ferrite | 2.20 |
| Pre. 13 | M | Core (b) | 28.2 | 4.3 | 94.7 | 99.1 | 57 | Cu—Zn ferrite | 2.20 |
| Pre. 14 | N | Core (b) | 28.2 | 4.3 | 94.7 | 99.1 | 57 | Cu—Zn ferrite | 2.20 |
| Pre. 15 | O | Core (b) | 28.2 | 4.3 | 94.7 | 99.1 | 57 | Cu—Zn ferrite | 2.20 |
| Pre. 16 | P | Core (l) | 28.4 | 1.8 | 94.2 | 99.7 | 57 | Cu—Zn ferrite | 2.19 |
| Pre. 17 | D' | Core (d) | 28.5 | 2.3 | 95.0 | 99.6 | 57 | Cu—Zn ferrite | 2.17 |

*Comparative Example

TABLE 1-2

| | characteristics of coated carriers | | | | | | | | |
|---|---|---|---|---|---|---|---|---|---|
| Preparation of carriers | electric resistance (LogR, Ω cm) | Under coated layer | content (%) of amino silane coupling agent | weight average diameter (μm) | content ratio (wt %) of small particles less than 20 μm diameter | content ratio (wt %) of particles less than 36 μm diameter | content ratio (wt %) of particles less than 44 μm diameter | Dw/Dp | thickness of coated layer (μm) |
| Pre. 1 | 15.1 | None | 0 | 28.7 | 6.6 | 91.3 | 98.2 | 1.16 | 0.35 |
| Pre. 2 | 15.3 | None | 0 | 28.7 | 3.4 | 93.3 | 98.6 | 1.12 | 0.35 |
| Pre. 3 | 15.0 | None | 0 | 24.9 | 3.2 | 94.7 | 99.1 | 1.10 | 0.34 |
| Pre. 4* | 15.1 | None | 0 | 28.6 | 8.1 | 91.1 | 98.1 | 1.22 | 0.36 |
| Pre. 5* | 15.2 | None | 0 | 29.8 | 4.3 | 81.0 | 93.2 | 1.21 | 0.35 |
| Pre. 6* | 15.0 | None | 0 | 28.5 | 8.2 | 83.5 | 94.3 | 1.24 | 0.34 |
| Pre. 7 | 15.1 | None | 0 | 28.8 | 1.9 | 93.2 | 98.6 | 1.13 | 0.35 |
| Pre. 8 | 15.2 | None | 0 | 29.0 | 3.8 | 93.6 | 99.0 | 1.12 | 0.37 |
| Pre. 9 | 15.3 | None | 0 | 28.7 | 3.2 | 94.0 | 98.8 | 1.14 | 0.35 |
| Pre. 10 | 15.0 | None | 0 | 28.8 | 4.1 | 94.2 | 98.9 | 1.13 | 0.36 |
| Pre. 11 | 15.1 | None | 0 | 28.6 | 3.9 | 93.1 | 98.5 | 1.10 | 0.36 |

TABLE 1-2-continued

| Preparation of carriers | characteristics of coated carriers | | | | | | | | |
|---|---|---|---|---|---|---|---|---|---|
| | electric resistance (LogR, Ω cm) | Under coated layer | content (%) of amino silane coupling agent | weight average diameter (μm) | content ratio (wt %) of small particles less than 20 μm diameter | content ratio (wt %) of particles less than 36 μm diameter | content ratio (wt %) of particles less than 44 μm diameter | Dw/Dp | thickness of coated layer (μm) |
| Pre. 12 | 13.5 | None | 0 | 28.9 | 4.5 | 94.0 | 99.0 | 1.12 | 0.35 |
| Pre. 13 | 13.6 | Exist | 0 | 28.2 | 4.6 | 93.7 | 98.9 | 1.13 | 0.37 |
| Pre. 14 | 15.1 | None | 2.0 | 28.2 | 3.9 | 93.2 | 98.7 | 1.14 | 0.34 |
| Pre. 15 | 15.3 | None | 0 | 28.8 | 4.1 | 93.4 | 98.9 | 1.13 | 0.35 |
| Pre. 16 | 15.1 | None | 0 | 29.1 | 1.6 | 92.8 | 99.5 | 1.12 | 0.34 |
| Pre. 17 | 15.2 | None | 0 | 29.0 | 2.5 | 93.9 | 99.2 | 1.11 | 0.36 |

*Comparative Example

TABLE 2

| | weight average diameter of toner (μm) | Carrier | | image density | uniformity of highlight (Grade) | Smear of background area (Grade) | Carrier deposition (Grade) | Smear in background after 20K run (Grade) |
|---|---|---|---|---|---|---|---|---|
| | | Carrier | toner charge to mass ratio at 50% covering (μc/g) | | | | | |
| Exp. 1 | 6.8 | A | 39 | 1.59 | 7 | 6 | 5 | 6 |
| Exp. 2 | 6.8 | B | 37 | 1.62 | 7 | 7 | 6 | 6 |
| Exp. 3 | 6.8 | C | 39 | 1.60 | 6 | 6 | 5 | 6 |
| Co-Exp. 1 | 6.8 | D | 38 | 1.63 | 3 | 3 | 2 | 2 |
| Co-Exp. 2 | 6.8 | E | 36 | 1.62 | 3 | 7 | 7 | 6 |
| Co-Exp. 3 | 6.8 | F | 38 | 1.60 | 2 | 3 | 3 | 2 |
| Exp. 4 | 6.8 | G | 37 | 1.59 | 8 | 8 | 8 | 7 |
| Exp. 5 | 6.8 | H | 39 | 1.62 | 8 | 8 | 8 | 7 |
| Exp. 6 | 6.8 | I | 37 | 1.61 | 8 | 8 | 8 | 7 |
| Exp. 7 | 6.8 | J | 36 | 1.63 | 8 | 8 | 8 | 7 |
| Exp. 8 | 6.8 | K | 38 | 1.59 | 8 | 8 | 7 | 7 |
| Exp. 9 | 6.8 | L | 35 | 1.61 | 8 | 8 | 8 | 7 |
| Exp. 10 | 6.8 | M | 37 | 1.62 | 8 | 8 | 9 | 7 |
| Exp. 11 | 6.8 | N | 39 | 1.61 | 7 | 9 | 8 | 9 |
| Exp. 12 | 6.8 | O | 26 | 1.74 | 8 | 8 | 8 | 8 |
| Exp. 13 | 4.6 | B | 41 | 1.58 | 9 | 7 | 6 | 6 |
| Exp. 14 | 6.8 | P | 36 | 1.63 | 9 | 10 | 9 | 9 |
| Exp. 15 | 6.8 | D' | 36 | 1.63 | 9 | 10 | 9 | 9 |
| Exp. 16 | 6.8 | B | 37 | 1.58 | 7 | 8 | 8 | 7 |

*Comparative Example

The above written description of the invention provides a manner and process of making and using it such that any person skilled in this art is enabled to make and use the same, this enablement being provided in particular for the subject matter of the appended claims, which make up a part of the original description.

All references, patents, applications, tests, standards, documents, publications, brochures, texts, articles, etc. mentioned herein are incorporated herein by reference. Also incorporated herein by reference are Japanese priority applications No. 2003-75631 and 2004-25283, filed on Mar. 19, 2003, and Feb. 2, 2004 to which priority is hereby claimed. Where a numerical limit or range is stated, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

What is claimed is:

1. A carrier comprising carrier particles, said particles comprising a magnetic core and a resin layer covering said core, wherein said carrier particles have a weight average particle diameter Dw which is 22–32 μm and a number average particle diameter Dp which meets with the following condition:

$$1<Dw/Dp<1.20,$$

and (1) wherein the amount of said carrier particles having a particle diameter of less than 20 μm is no more than 7 wt % of the total weight of said particles, (2) wherein the amount of said carrier particles having a particle diameter of less than 36 μm is 90–100 wt % of the total weight of said particles, and (3) wherein the amount of said carrier particles having a particle diameter of less than 44 μm is 98–100 wt % of the total weight of said particles.

2. The carrier as claimed in claim 1, wherein said particles have a weight average particle diameter Dw which is 22–30

μm, and wherein the amount of said carrier particles having a particle diameter of less than 20 μm is no more than 5 wt %.

3. The carrier as claimed in claim 1, wherein the amount of said carrier particles having a particle diameter of less than 20 μm is no more than 3 wt %.

4. The carrier as claimed in claim 1, wherein said carrier particles provide a magnetic moment of from 70 to 150 emu/g in an applied magnetic field at 1 KOe.

5. The carrier as claimed in claim 1, wherein said carrier particles have a core of MnMgSr ferrite material.

6. The carrier as claimed in claim 1, wherein said carrier particles have a core of Mn ferrite material.

7. The carrier as claimed in claim 1, wherein said carrier particles have a core of a magnetite material.

8. The carrier as claimed in claim 1, wherein the bulk density of the magnetic core is 2.35 to 2.50 g/cm$^3$.

9. The carrier as claimed in claim 1, wherein the specific electro-resistance denoted by (log R, Ω cm) of the carrier is 12.0 to 14.0.

10. The carrier as claimed in claim 1, wherein a resistance of an inner resin layer is more than that of a surface resin layer.

11. A carrier as claimed in claim 10, wherein said resin layer comprises a silicone resin containing aminosilane coupling agent.

12. An electrophotographic developer comprising toner and a carrier according to claim 1.

13. An image forming method, comprising developing an image with the developer of claim 12.

14. An electrophotographic developer as claimed in claim 12, wherein toner charge to mass ratio, when used in such an amount as to provide a covering ratio of 50%, is 15 to 35 μc/g.

15. An electrophotographic developer as claimed in claim 12, wherein said toner particles have a weight average particle diameter of from 3.0 to 5.0 μm.

16. A method for preparing a carrier for an electrophotographic developer, said carrier comprising carrier particles, each carrier particle comprising a magnetic core and a resin layer on the surface of said magnetic core; said method comprising:

(i) classifying a magnetic material of finely pulverized particles, thereby obtaining magnetic core particles having a weight average particle diameter Dw which is 22–32 μm and wherein the amount of said carrier particles having a particle diameter of less than 20 μm is no more than 7 wt % of the total weight of said particles, wherein the amount of said carrier particles having a particle diameter of less than 36 μm is less than 90 wt % of the total weight of said particles, wherein the amount of said carrier particles having a particle diameter of less than 44 μm is less than 98 wt % of the total weight of said particles, and (ii) providing a resinous film onto the magnetic core particles.

17. A method as claimed in claim 16, wherein classifying is accomplished by a vibration sieve equipped with an ultrasonic wave-generator.

18. A method as claimed in claim 17, wherein the vibration sieve is equipped with an ultrasonic wave-generator and a resonator ring to transfer ultrasonic waves generated by the ultrasonic wave-generator to the vibration sieve.

19. A method as claimed in claim 16, further comprising classifying the particles having a resinous film thereon with a vibration sieve equipped with an ultrasonic wave-generator.

20. A method as claimed in claim 19, wherein the vibration sieve is equipped with an ultrasonic wave-generator and a resonator ring to transfer ultrasonic waves generated by the ultrasonic wave-generator to the vibration sieve.

21. A process cartridge which is freely attachable to an electrophotographic image forming apparatus and detachable therefrom, wherein said process cartridge comprises dry toner and a carrier according to claim 1.

22. A method for preparing a carrier for an electrophotographic developer, said carrier comprising carrier particles, each carrier particle comprising a magnetic core and a resin layer on the surface of said magnetic core; said method comprising:

providing a resinous film onto the magnetic core particles, classifying a magnetic core particles of finely pulverized particles, thereby obtaining magnetic core particles having a weight average particle diameter Dw which is 22–32 μm and a number average particle diameter Dp which meets with the following condition:

$$1<Dw/Dp<1.20,$$

wherein the amount of said carrier particles having a particle diameter of less than 20 μm is no more than 7 wt % of the total weight of said particles, wherein the amount of said carrier particles having a particle diameter of less than 36 μm is less than 90 wt % of the total weight of said particles, wherein the amount of said carrier particles having a particle diameter of less than 44 μm is less than 98 wt % of the total weight of said particles.

* * * * *